US006261758B1

(12) United States Patent
Wirowski et al.

(10) Patent No.: US 6,261,758 B1
(45) Date of Patent: Jul. 17, 2001

(54) PRODUCTION OF SILVER HALIDE EMULSIONS

(75) Inventors: Ralf Wirowski, Köln; Hans-Ulrich Borst, Elsdorf; Detlev Kapitza; Jörg Siegel, both of Köln; Peter Bergthaller, Bergisch Gladbach; Heinrich Odenwälder, Leverkusen, all of (DE)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 09/616,445

(22) Filed: Jul. 14, 2000

(30) Foreign Application Priority Data

Jul. 15, 1999 (DE) ..... 199 33 258

(51) Int. Cl.[7] ..... G03C 1/035
(52) U.S. Cl. ..... 430/569; 430/567
(58) Field of Search ..... 430/569, 567

(56) References Cited

U.S. PATENT DOCUMENTS 3,661,592 * 5/1972 Philippaerts et al. ..... 430/569
3,847,617 * 11/1974 Philippaerts et al. ..... 430/569
4,631,253 * 12/1986 Mifune et al. ..... 430/569
5,006,457 4/1991 Vetter et al. ..... 430/613
5,411,851 * 5/1995 Maskasky ..... 430/569
5,427,904 6/1995 Borst et al. ..... 430/569
5,468,602 * 11/1995 Takahashi ..... 430/569
5,491,056 * 2/1996 Wen et al. ..... 430/569

FOREIGN PATENT DOCUMENTS 4233714 4/1994 (DE) .
19831281 1/2000 (DE) .
369235 5/1990 (EP) .

* cited by examiner

*Primary Examiner*—Hoa Van Le
(74) *Attorney, Agent, or Firm*—Connolly Bove Lodge & Hutz LLP

(57) ABSTRACT

The production of tabular silver bromide-iodide emulsions and silver bromide-chloride-iodide emulsions with an aspect ratio $^{3}$2, an iodide content from 1 to 40 mol % and a chloride content from 0 to 20 mol %, by the process steps of (a) silver halide nucleus precipitation, and (b) at least one further precipitation of silver halide, wherein rein at least one aromatic five- or six-membered, heterocyclic compound, which is free from—SH—,—$SSO_2H$— and—$SSO_2R$ groups, is added in an amount from $10^{-9}$ to $10^{-4}$ mol/mol silver during nucleus precipitation or during the precipitation of an inner zone of the silver halide grain which is different from the nucleus precipitate, results in an improved speed/grain size ratio and in an increased stability of a photographic material which contains an emulsion produced in this manner.

13 Claims, No Drawings

PRODUCTION OF SILVER HALIDE EMULSIONS

This invention relates to a process for producing tabular silver bromide-iodide emulsions and silver bromide-chloride-iodide emulsions with an aspect ratio ≧2, an iodide content from 1 to 40 mol % and a chloride content from 0 to 20 mol %, by the process less steps. of (a) silver halide nucleus precipitation, and (b) at least one further precipitation of silver halide, in order to achieve an improved speed/grain size ratio and in order to achieve a higher stability of a photographic material which contains an emulsion produced in this manner.

The aspect ratio of a tabular silver halide emulsion is the ratio of the average diameter of the projected area of the equivalent circle to the average thickness of the grains.

It is known from U.S. Pat. No. 5,482,825 that a higher film speed and a reduced pressure sensitivity can be achieved by the addition of condensed dihydropyrimidines during the production of the emulsion.

In order to obtain a high speed/fogging ratio and good latent image stability, it is advantageous, during the production of the emulsion, to employ heterocycles which reduce fogging due to their substitution, as is described in JN 3,196,138 for thiosulphonate and as is described in JN 3,039,946 for mercapto-substituted heterocycles.

It is known from EP 337,370 that a silver halide zone with a low iodide content can be precipitated on to a silver halide zone with a high iodide content after the adsorption of surface-active substances (spectral sensitisers, stabilisers comprising SH groups, anti-fogging agents).

It is known from EP 462,579 that a silver halide zone with a higher iodide content can be formed in the presence of 5- or 6-membered ring heterocycles comprising an —SH group, in order to achieve a higher speed, low fogging, reduced granularity and good stability on storage.

The techniques described above are not capable of improving the speed/grain size ratio, or in other words of improving the speed whilst the grain size remains constant. The object of the present invention was to eliminate this disadvantage.

This object is achieved by the addition of at least one aromatic five- or six-membered, heterocyclic compound, which is free from —SH—, —$SSO_2H$— and —$SSO_2R$ groups, in an amount from $10^{-9}$ to $10^{-4}$ mol/mol silver, during nucleus precipitation or during the precipitation of an inner zone of the silver halide grain which is different from the nucleus precipitate.

The present invention thus relates to the process cited at the outset, characterised in that the aforementioned measure is carried out.

Further silver halide precipitations which follow the precipitation of nuclei can be effected by adding soluble silver salts and soluble halides or by adding and depositing a fine-grained micrate emulsion.

Other preferred embodiments of the invention are given in the subsidiary claims.

The heterocyclic compound can also be a constituent of a condensed ring system.

Suitable compounds correspond to formulae I to VII given below:

(I)

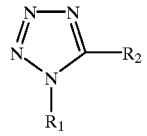

wherein $R_1$ denotes H, alkyl or aryl, $R_2$ denotes —$SR_3$ or—$NHCOR_3$, and $R_3$ denotes alkyl;

(II)

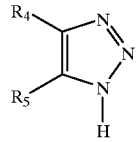

wherein $R_4$ denotes H, alkyl, aryl or —S—$R_3$ $R_5$ denotes H, alkyl, aryl, —$SR_3$, —$COR_6$, —$COOR_6$, CN or hetaryl, $R_6$ denotes alkyl or aryl, and $R_3$ has the given meaning;

(III)

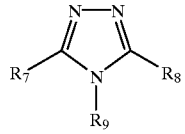

wherein $R_7$ and $R_8$, independently of each other, denote H, alkyl, —$SR_3$, aryl or hetaryl, $R_9$ denotes H or alkyl, and $R_3$ has the given meaning;

(IV)

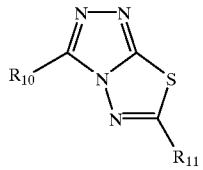

wherein $R_{10}$ and $R_{11}$, independently of each other, denote H, alkyl or —$SR_3$ and $R_3$ has the given meaning;

(V)

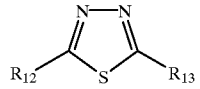

wherein the radicals $R_{12}$ and $R_{13}$ are identical or different and denote H, alky, —$NH_2$ or —$SR_3$, wherein $R_3$ has the given meaning;

(VI)

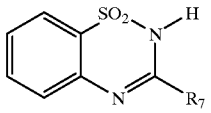

wherein $R_3$ and $R_7$ have the given meanings;

(VII)

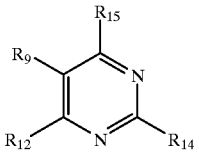

wherein $R_{14}$ denotes H, alkyl, —$SR_3$ or $NHCOR_3$, $R_{15}$ denotes H, alkyl, $NH_2$ or OH, and $R_3$, $R_9$ and $R_{12}$ have the given meanings.

The alkyl, aryl and hetaryl groups can be unsubstituted or substituted, wherein SH groups, $SSO_2H$ groups and $SSO_2$—R groups are excluded.

Examples include:

Formula I

I-1: $R_1$=phenyl; $R_2$=—S—$CH_2$—COOH

I-2: $R_1$=H; $R_2$=—S—$CH_2$—COOH

I-3: $R_1$=H; $R_2$ =—$NHCOCH_3$

Formula II

II-1: $R_4$=—S—$C_5H_{11}$; $R_5$ =phenoxycarbonyl

II-2 $R_4$=$CH_3$; $R_5$=4-ethoxycarbonylphenoxycarbonyl

II-3: $R_4$=$CH_3$; $R_5$=—$COOC_9H_{19}$

II-4: $R_4$=—$C(CH_3)_3$; $R_5$=—CN

II-5: $R_4$=4-chlorophenyl; $R_5$=4-methyl-1, 3-thiazolyl-2-

II-6: $R_4$=H; $R_5$=1-(2-tolyloxycarbonyl)-propylmercapto

II-7: $R_4$=H; $R_5$=—S—$CH(C_4H_9)COOCH_2CF_3$

II-8: $R_4$=H; $R_5$=—S—$CH_2COOC_6H_{13}$

II-9: $R_4$=$CH_3$; $R_5$=—$COOC_6H_{13}$

Formula III

III-1: $R_9$=H; $R_7$=—S—$C_6H_{13}$; $R_8$=2-furyl

III-2: $R_9$=H; $R_7$=—$SCH_2COOH$; $R_8$=H

III-3: $R_9$=H; $R_7$=—$SCH(CH_3)COOH$; $R_8$=H

III-4: $R_9$=$CH_2OH$; $R_7$=H; $R_{8=H}$

III-5: $R_9$=$CH_2COOH$; $R_7$=—$SCH_3$, $R_8$=—$CH_3$

Formula IV

IV-1: $R_{10}$=H; $R_{11}$=$C_2H_5$

IV-2: $R_{10}$=$SCH_2COOH$; $R_{11}$=$CH_2CH_2COOC_5H_{11}$

Formula V:

V-1: $R_{12}NH_2$; $R_{13}$=$SCH_2COOH$

V-2: $R_{12}$=$SC_2H_5$; $R_{13}$=$SCH_2COOH$

V-3: $R_{12}$=H; $R_{13}$=$SCH_2COOH$

V-4: $R_{12}$=$SCH_2COOH$; $R_{13}$=$SCH_2COOH$

V-5: $R_{12}$=$SC_2H_5$; $R_{13}$=S—$CH_2COOC_5H_{11}$

Formula VI:

VI-1: $R_7$=H

VI-2: $R_7$=$SCH_2COOH$

VI-3: $R_7$=$SC_6H_{13}$

Formula VII

VII-1: $R_{14}$=$SCH_2COOH$; $R_{15}$=$CH_3$; $R_9$=H; $R_{12}$=$SCH_2COOH$

VII-2: $R_{14}$=$SCH_2COOH$; $R_{15}$=OH; R=H; $R_{12}$=$NH_2$

VII-3: $R_{14}$=$NHCOCH_2CH_2COOH$; $R_{15}$=$CH_3$; $R_9$=H: $R_{12}$=H

VII-4: $R_{14}$=$SCH_2COOH$; $R_{15}$=$CH_3$; $R_9$=H; $R_{12}$=H

Compounds of formulae I and II are particularly preferred. The following were tested as comparison compounds:

X-1

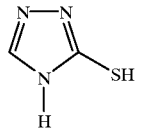

X-2

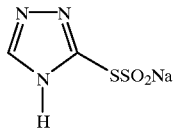

X-3

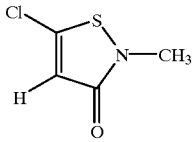

The silver halide emulsions which are produced according to the invention are used in particular in photographic films, preferably in colour negative films.

Photographic films consist of a support on which at least one light-sensitive silver halide emulsion layer is deposited. Thin films and foils are particularly suitable as supports. A review of support materials and of the auxiliary layers which are deposited on the front and back thereof is given in Research Disclosure 37254, Part 1 (1995), page 285 and in Research Disclosure 38957, Part XV (1996), page 627.

Photographic films usually contain at least one red-sensitive, at least one green-sensitive and at least one blue-sensitive silver halide emulsion layer, and optionally contain intermediate layers and protective layers also.

Depending on the type of photographic film, these layers may be arranged differently. This will be illustrated for the most important products:

Colour photographic films such as colour negative films and colour reversal films comprise, in the following sequence on their support: 2 or 3 red-sensitive, cyan-coupling silver halide emulsion layers, 2 or 3 green-sensitive, magenta coupling silver halide emulsion layers, and 2 or 3 blue-sensitive, yellow-coupling silver halide emulsions layers. The layers of identical spectral sensitivity differ as regards their photographic speed, wherein the less sensitive partial layers are generally disposed nearer the support than are the more highly sensitive partial layers.

A yellow filter layer is usually provided between the green-sensitive and blue-sensitive layers, to prevent blue light from reaching the layers underneath.

The options for different layer arrangements and their effects on photographic properties are described in J. Inf Rec. Mats., 1994, Vol. 22, pages 183–193, and in Research Disclosure 38957, Part XI (1996), page 624.

Departures from the number and arrangement of the light-sensitive layers may be effected in order to achieve defined results. For example, all the high-sensitivity layers may be combined to form a layer stack and all the low-sensitivity layers may be combined to form another layer stack in a photographic film, in order to increase the sensitivity (DE-25 30 645).

The essential constituents of the photographic emulsion layers are binders, silver halide grains and colour couplers.

Information on suitable binders is given in Research Disclosure 37254, Part 2 (1995), page 286, and in Research Disclosure 38957, Part II.A (1996), page 598.

Information on suitable silver halide emulsions, their production, ripening, stabilisation and spectral sensitisation, including suitable spectral sensitisers, is given in Research Disclosure 37254, Part 3 (1995), page 286, in Research Disclosure 37038, Part XV (1995), page 89, and in Research Disclosure 38957, Part V.A (1996), page 603.

Photographic materials which exhibit camera-sensitivity usually contain silver bromide-iodide emulsions, which may also optionally contain small proportions of silver chloride.

Information on colour couplers is to be found in Research Disclosure 37254, Part 4 (1995), page 288, in Research Disclosure 37038, Part 11 (1995), page 80, and in Research Disclosure 38957, Part X.B (1996), page 616. The maximum absorption of the dyes formed from the couplers and from the colour developer oxidation product preferably falls within the following ranges: yellow couplers 430 to 460 nm, magenta couplers 540 to 560 nm, cyan couplers 630 to 700 run.

In order to improve sensitivity, granularity, sharpness and colour separation, compounds are frequently used in colour photographic films which on reaction with the developer oxidation product release compounds which are photographically active, e.g. DIR couplers, which release a development inhibitor.

Information on compounds such as these, particularly couplers, is to be found in Research Disclosure 37254, Part 5 (1995), page 290, in Research Disclosure 37038, Part XIV (1995), page 86, and in Research Disclosure 38957, Part X.C (1996), page 618.

The colour couplers, which are mostly hydrophobic, and other hydrophobic constituents of the layers also, are usually dissolved or dispersed in high-boiling organic solvents. These solutions or dispersions are then emulsified in an aqueous binder solution (usually a gelatine solution), and after the layers have been dried are present as fine droplets (0.05 to 0.8 $\mu$m diameter) in the layers.

Suitable high-boiling organic solvents, methods of introduction into the layers of a photographic material, and other methods of introducing chemical compounds into photographic layers, are described in Research Disclosure 37254, Part 6 (1995), page 292.

The light-insensitive intermediate layers which are generally disposed between layers of different spectral sensitivity may contain media which prevent the unwanted diffusion of developer oxidation products from one light-sensitive layer into another light-sensitive layer which has a different spectral sensitivity.

Suitable compounds (white couplers, scavengers or DOP scavengers) are described in Research Disclosure 37254, Part 7 (1995), page 292, in Research Disclosure 37038, Part III (1995), page 84, and in Research Disclosure 38957, Part X.D (1996), page 621 et seq.

The photographic material may additionally contain compounds which absorb UV light, brighteners, spacers, filter dyes, formalin scavengers, light stabilisers, anti-oxidants, $D_{Min}$ dyes, plasticisers (latices), biocides, additives for improving the coupler-and dye stability, to reduce colour fogging and to reduce yellowing, and other substances. Suitable compounds are given in Research Disclosure 37254, Part 8 (1995), page 292, in Research Disclosure 37038, Parts IV, V, VI, VII, X, XI and XIII (1995), pages 84 et seq., and in Research Disclosure 38957, Parts VI, VIII, IX, X (1996), pages 607, 610 et seq.

The layers of colour photographic materials are usually hardened, i.e. the binder used, preferably gelatine, is crosslinked by suitable chemical methods.

Suitable hardener substances are described in Research Disclosure 37254, Part 9 (1995), page 294, in Research Disclosure 37038, Part XII (1995), page 86, and in Research Disclosure 38957, Part II.B (1996), page 599.

After image-by-image exposure, colour photographic materials are processed by different methods corresponding to their character. Details on the procedures used and the chemicals required therefor are published in Research Disclosure 37254, Part 10 (1995), page 294, in Research Disclosure 37038, Parts XVI to XXIII (1995), page 95 et seq., and in Research Disclosure 38957, Parts XVIII, XIX, XX (1996), together with examples of materials.

Preparation of Emulsions

Comparison Emulsion Em-1

Step a)

A solution of 110 g inert gelatine and 85 g potassium bromide was made up in 7 kg water, with stirring.

Step b)

An aqueous silver nitrate solution (36 g silver nitrate in 400 g water) and an aqueous halide solution (26 g potassium bromide in 400 g water) were metered in as a double inflow at 40° C. over 2 minutes.

Step c)

This was followed by the addition of 220 g inert gelatine in 880 g water. After heating to 60° C., an aqueous silver nitrate solution (89 g silver nitrate in 300 g water) was added over 4 minutes, in order to obtain a pBr of 2.0 in the dispersion medium.

Thereafter, the batch was heated to 65° C. again, followed by a second double inflow, in which an aqueous silver nitrate solution (150 g silver nitrate in 900 g water) and an aqueous halide solution (35 g potassium iodide and 64 g potassium bromide in 900 g water) were added over 8 minutes. During the addition, the pBr in the dispersion medium was held constant at the initial value of 2.0.

Step d)

After an interval of 2 minutes, a third double inflow was effected at 65° C. After adjusting the pBr in the dispersion medium to 1.7 with aqueous 2 N KBr solution, an aqueous silver nitrate solution (1020 g silver nitrate in 2.5 kg water) and an aqueous halide solution (607 g potassium bromide in 2.5 kg water) were added over 15 minutes. The pBr in the dispersion medium was held constant at the initial value of 1.7 during this stage. After the last inflow, the emulsion was cooled to 25° C. and was flocculated by the addition of polystyrenesulphonic acid at pH 3.5, followed by washing at a temperature of 20° C. Thereafter, the flocculate was re-dispersed by the addition of 59 g inert gelatine in 2.6 kg water at pH 6.5 and at a temperature of 50° C. The AgBrI emulsion consisted of more than 80%, with respect to the projected area of the crystals, of hexagonal tab grains with an aspect ratio of 6 and a side length ratio between 1.0 and 1.5. The grain size was 0.45 $\mu$m, the breadth of distribution was 19% and the iodide content was 2.8 mol %.

Comparison Emulsion Em-2

Solution 1: 6000 g silver nitrate in 36 kg water, heated to 80° C.

Solution 2: 1290 g potassium iodide in 1.8 kg water, heated to 80° C.

Solution 3: 4000 g ammonium bromide in 20 kg water, heated to 80° C.

I) Preparation of the Preliminary Precipitate

Step a)

A solution of 2880 g inert gelatine and 586 g potassium iodide in 130 kg water was introduced into the batch container with stirring. The pH of this starting solution was adjusted to 4.0 with 3 N $HNO_3$ at 70° C.

Step b)

Thereafter, solution 1 and solution 3 were metered in as a double inflow over 15 minutes at 79° C.

Step c)

After a digestion interval of 10 minutes, solution 2 was added over 6 minutes at 79° C.

After cooling to 25° C., the emulsion was flocculated by adding PSS at pH 3.3 and was subsequently washed at 20° C. Thereafter, the flocculate was re-dispersed by adding 10 kg water at pH 6.5 and at a temperature of 50° C.

The emulsion had a high content of hexagonal tabular crystals. The mean particle size by volume was 0.45 μm, the iodide content was 32% and the breadth of distribution was 25%.

II) Production of the Micrate Emulsion

A micrate emulsion was produced in a separate vessel by a pAg-controlled double inflow. The emulsion consisted of 100% silver bromide and contained 1.25 mol AgBr/kg and 28 g gelatine/kg. The average particle size by volume was 0.05 μm.

III) Production of the Emulsion by Depositing the Micrate Emulsion Described in II) on to the Preliminary Precipitate Described in I)

Step d)

The micrate emulsion and the preliminary precipitate were mixed in a ratio of 5:1 (with respect to their Ag contents) and were digested at 65° C., at pH 7.0 and at a UAg of −60 mV until deposition was complete. The batch was subsequently coagulated, washed, and re-dispersed by adding water and gelatine. The emulsion which was obtained had a high content of hexagonal, tabular crystals with an aspect ratio of 6. The average particle size by volume was 0.85 μm, the iodide content was 5.3% and the breadth of distribution was 30%.

Comparison Emulsion Em-3

I) Production of the AgI Preliminary Precipitate According to EP 359 507, Example I:

Step a)

2600 ml of a 9.6% by weight aqueous solution of an inert gelatine were placed at 40° C., with stirring, in a batch container. The pI was adjusted to 1 with about 53 ml of a 4.7 molar potassium iodide solution.

Step b)

4.7 molar aqueous solutions of silver nitrate and potassium iodide were then run into the initial batch with stirring, with the rate of inflow of the silver nitrate solution being linearly increased from 20 to 33 ml/min, until a total of 1.6 liters had been added over 65 minutes. Further volumes of these solutions were then added, with the rate of inflow being linearly increased from 50 to 90 ml/min, until a total of 10.8 liters of silver nitrate solution had been added over 162 minutes. During the addition, the pI of the emulsion was maintained at a value of 1±0.05 by regulating the addition of the potassium iodide solution. The temperature was maintained at 40° C. The yield was 58.5 mol silver iodide. 3420 g of a 27% by weight aqueous gelatine solution were added, and the emulsion was subsequently desalinated.

The emulsion contained 240 g $AgNO_3$/kg and had a gelatine/silver nitrate ratio of 0.12. The resulting emulsion had a grain size of 0.32 μm. The crystals consisted of 100% silver iodide and were of simple pyramidal habit.

II) Production of an AgBrI Preliminary Precipitate by Recrystallisation From the AgI Preliminary Precipitate Produced in I)

Step c)

9.16 kg of the emulsion prepared in I) were heated to 40° C. with stirring and were treated with 1496 g gelatine and 5.03 kg water. The batch was then heated to 70° C. and a 1.5 molar silver nitrate solution together with a 1.7 molar ammonium bromide solution were added as a double inflow at a constant rate of 460 ml/min and at a pH of 5.6. The batch was subsequently cooled to 30° C., its pH was adjusted to 3.5 with sulphuric acid, and it was flocculated by polystyrenesulphonic acid and then washed. After re-dispersion, the silver nitrate content was adjusted to 200 g silver nitrate/kg by adding water. The gelatine/silver nitrate ratio was 0.2, and the average grain size was 0.46 μm. The resulting emulsion had an iodide content of 25 mol % and consisted of lamellar crystals with an aspect ratio of about 4.

III) Production of a 5 mol % AgBrI Emulsion by Depositing an AgBr Micrate Emulsion on to the AgBrI Preliminary Precipitate Produced in II)

Step d)

25.24 kg of the tab emulsion produced in II) were digested at 40° C. together with 100 kg of a fine-grained AgBr emulsion with a grain size of about 40 nm, a gelatine/silver nitrate ratio of 0.133 and 210 g silver nitrate/kg. After adding 21.18 mol ammonium bromide as an aqueous solution, the fine-grained AgBr emulsion was deposited at 65° C. on to the AgBrI preliminary precipitate at pH 7.2 and UAg=−70 mV for 30 minutes. After subsequent cooling to 30° C., its pH was adjusted with sulphuric acid, and it was flocculated by polystyrenesulphonic acid and then washed. Re-dispersion was effected at pH 6.8. The gelatine/silver nitrate ratio was adjusted to 0.2 with gelatine, and the silver nitrate content was adjusted to 200 g silver nitrate/kg with water. The resulting tab emulsion, which contained 5 mol % iodide, had an aspect ratio of 7 at a breadth of distribution of 25% and a grain size of 0.80 μm.

Emulsions Em-4 to Em-22 were prepared as was Em-1, except that at the start of the production step given in Table 1 the compounds listed in Table 1 were added in the amounts which are also given there. The aspect ratio and iodide content of the emulsions remained substantially unchanged. The solvent for the compounds had water as its main constituent, the solubility being improved if necessary by adding a little methanol or alkali. ST-1 was 4-hydroxy-6-methyl-1,3,3a,7-tetra-azaindene.

TABLE 1

| Emulsion | Step | Compound | Amount [mol/mol Ag] | Place of addition | |
|---|---|---|---|---|---|
| Em-1 | — | — | | | comparison |
| Em-4 | b) | III-2 | 0.61 | nucleus precipitate | comparison |
| Em-5 | d) | III-2 | 0.08 | high-iodide zone | comparison |
| Em-6 | e) | III-2 | 0.017 | AgBr shell | comparison |
| Em-7 | d) | X-1 | $1*10^{-6}$ | high-iodide zone | comparison |
| Em-8 | d) | X-2 | $1*10^{-6}$ | high-iodide zone | comparison |
| Em-9 | d) | X-3 | $1*10^{-6}$ | high-iodide zone | comparison |
| Em-10 | d) | ST-1 | $1*10^{-6}$ | high-iodide zone | comparison |
| Em-11 | b) | III-2 | $1*10^{-6}$ | nucleus precipitate | invention |
| Em-12 | d) | III-2 | $1*10^{-6}$ | high-iodide zone | invention |
| Em-13 | e) | III-2 | $1*10^{-6}$ | AgBr shell | invention |
| Em-14 | d) | III-2 | $1*10^{-4}$ | high-iodide zone | invention |
| Em-15 | d) | III-2 | $1*10^{-8}$ | high-iodide zone | invention |

TABLE 1-continued

| Emulsion | Step | Compound | Amount [mol/mol Ag] | Place of addition | |
|---|---|---|---|---|---|
| Em-16 | b) | II-9 | $1*10^{-7}$ | nucleus precipitate | invention |
| Em-17 | d) | II-9 | $1*10^{-7}$ | high-iodide zone | invention |
| Em-18 | e) | II-9 | $1*10^{-7}$ | AgBr shell | invention |
| Em-19 | b) | V-3 | $1*10^{-7}$ | nucleus precipitate | invention |
| Em-20 | d) | V-3 | $1*10^{-7}$ | high-iodide zone | invention |
| Em-21 | e) | V-3 | $1*10^{-7}$ | AgBr shell | invention |
| Em-22 | e) | V-3 | $1*10^{-6}$ | AgBr shell | invention |

Emulsions Em-23 to Em-41 were prepared as was Em-2, except that at the start of the production step given in Table 2 the compounds listed in Table 2 were added in the amounts which are also given there. The aspect ratio and iodide content of the emulsions remained substantially unchanged. The solvent for the compounds had water as its main constituent, the solubility being improved if necessary by adding a little methanol or alkali.

TABLE 2

| Emulsion | Step | Compound | Amount [mol/mol Ag] | Place of addition | |
|---|---|---|---|---|---|
| Em-2 | — | | | | comparison |
| Em-23 | b) | III-2 | 0.61 | nucleus precipitate | comparison |
| Em-24 | c) | III-2 | 0.08 | iodide conversion | comparison |
| Em-25 | d) | III-2 | 0.017 | AgBr-micrate deposition | comparison |
| Em-26 | c) | X-1 | $1*10^{-6}$ | iodide conversion | comparison |
| Em-27 | c) | X-2 | $1*10^{-6}$ | iodide conversion | comparison |
| Em-28 | c) | X-3 | $1*10^{-6}$ | iodide conversion | comparison |
| Em-29 | c) | ST-1 | $1*10^{-6}$ | iodide conversion | comparison |
| Em-30 | b) | III-2 | $1*10^{-6}$ | nucleus precipitate | invention |
| Em-31 | c) | III-2 | $1*10^{-6}$ | iodide conversion | invention |
| Em-32 | d) | III-2 | $1*10^{-6}$ | AgBr-micrate deposition | invention |
| Em-33 | c) | III-2 | $1*10^{-4}$ | iodide conversion | invention |
| Em-34 | c) | III-2 | $1*10^{-8}$ | iodide conversion | invention |
| Em-35 | b) | II-9 | $1*10^{-7}$ | nucleus precipitate | invention |
| Em-36 | c) | II-9 | $1*10^{-7}$ | iodide conversion | invention |
| Em-37 | d) | II-9 | $1*10^{-7}$ | AgBr-micrate deposition | invention |
| Em-38 | b) | V-3 | $1*10^{-7}$ | nucleus precipitate | invention |
| Em-39 | c) | V-3 | $1*10^{-7}$ | iodide conversion | invention |
| Em-40 | d) | V-3 | $1*10^{-7}$ | AgBr-micrate deposition | invention |
| Em-41 | d) | V-3 | $1*10^{-6}$ | AgBr-micrate deposition | invention |

Emulsions Em-42 to Em-60 were prepared as was Em-3, except that at the start of the production step given in Table 3 the compounds listed in Table 3 were added in the amounts which are also given there. The aspect ratio and iodide content of the emulsions remained substantially unchanged. The solvent for the compounds had water as its main constituent, the solubility being improved if necessary by adding a little methanol or alkali.

TABLE 3

| Emulsion | Step | Compound | Amount [mol/mol Ag] | Place of addition | |
|---|---|---|---|---|---|
| Em-3 | — | — | | | comparison |
| Em-42 | b) | III-2 | 0.61 | nucleus precipitate | comparison |
| Em-43 | c) | III-2 | 0.08 | recrystallisation | comparison |
| Em-44 | d) | III-2 | 0.017 | AgBr-micrate deposition | comparison |

TABLE 3-continued

| Emulsion | Step | Compound | Amount [mol/mol Ag] | Place of addition | |
|---|---|---|---|---|---|
| Em-45 | c) | X-1 | $1*10^{-6}$ | recrystallisation | comparison |
| Em-46 | c) | X-2 | $1*10^{-6}$ | recrystallisation | comparison |
| Bm-47 | c) | X-3 | $1*10^{-6}$ | recrystallisation | comparison |
| Em-48 | c) | ST-1 | $1*10^{-6}$ | recrystallisation | comparison |
| Em-49 | b) | III-2 | $1*10^{-6}$ | nucleus precipitate | invention |
| Em-50 | c) | III-2 | $1*10^{-6}$ | recrystallisation | invention |
| Em-51 | d) | III-2 | $1*10^{-6}$ | AgBr-micrate deposition | invention |
| Em-52 | c) | III-2 | $1*10^{-4}$ | recrystallisation | invention |
| Em-53 | c) | III-2 | $1*10^{-8}$ | recrystallisation | invention |
| Em-54 | b) | II-9 | $1*10^{-7}$ | nucleus precipitate | invention |
| Bm-55 | c) | II-9 | $1*10^{-7}$ | recrystallisation | invention |
| Em-56 | d) | II-9 | $1*10^{-7}$ | AgBr-micrate deposition | invention |
| Em-57 | b) | V-3 | $1*10^{-7}$ | nucleus precipitate | invention |
| Em-58 | c) | V-3 | $1*10^{-7}$ | recrystallisation | invention |
| Em-59 | d) | V-3 | $1*10^{-7}$ | AgBr-micrate deposition | invention |
| Em-60 | d) | V-3 | $1*10^{-6}$ | AgBr-micrate deposition | invention |

Emulsion Em-1, as well as emulsions Em-4 to Em-22, were each chemically ripened in the optimum manner, at 52° C., at a UAg of 90 mV and at pH 6.0, with 550 μmol potassium thiocyanate, 5.0 μmol tetrachloroauric acid, 10 μmol sodium thiosulphate and 4 μmol triphenylphosphine selenide, per mol Ag in each case, and were subsequently spectrally sensitised with 520 μmol GS-1, 150 μmol GS-2 and 120 μmol GS-3, per mol Ag in each case.

Emulsions Em-2, as well as emulsions Em-23 to Em-60, were each chemically ripened in the optimum manner, at 40° C., at a UAg of 90 mV and at pH 6.0, with 450 μmol potassium thiocyanate, 3.5 μmol tetrachloroauric acid, 12.3 μmol sodium thiosulphate and 4.4 μmol triphenylphosphine selenide, per mol Ag in each case, and were subsequently spectrally sensitised with 390 μmol GS-1, 110 μmol GS-2 and 90 μmol GS-3, per mol Ag in each case.

GS-1

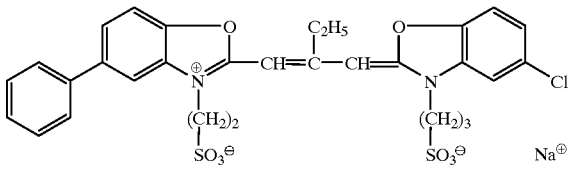

GS-2

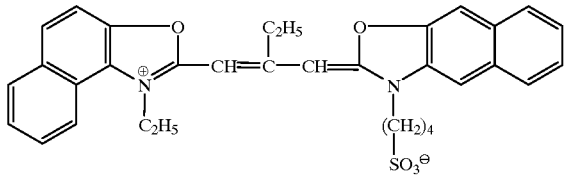

-continued

GS-3

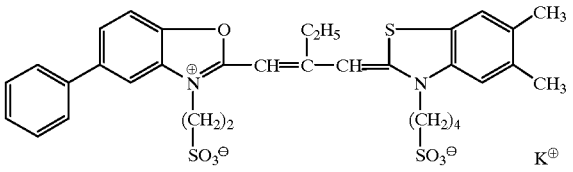

EXAMPLE 1

Emulsions Em-1 to Em-60 were each cast, together with an emulsion comprising the magenta coupler M-1, 4 mmol 4-hydroxy-6-methyl-1,3,3a,7-tetraazaindene and 80 $\mu$mol 1-phenyl-5-mercaptotetrazole (ST-2) per mol Ag, on to a cellulose triacetate film of thickness 120 $\mu$m, with following amounts being deposited per $m^2$:

4.0 g emulsion (with respect to $AgNO_3$)

3.0 g gelatine, and 0.8 g magenta coupler M-1

The chemical structural formula of M-1 is given in Example 2.

The hardened, dried film samples were exposed to daylight behind a graduated neutral wedge filter. Thereafter, the materials were processed by the process described in The British Journal of Photography 1974, page 597. The speed (S) and fogging (F) were determined. The speed data are given with respect to a density of 0.2 above fogging, with relative values being quoted, and with the speed of emulsion Em-1 being arbitrarily given the numerical value 100.

To check their stability in their packaged state (ΔS(pack)), the film samples were drawn into a miniature cassette and the latter was sealed in an air-tight plastics container of conventional size. After storing this container for 10 days at 50° C., the speed of the stored material was determined as described above. The ΔS(pack) values were calculated from the formula: S(stored)−S(fresh). Even for individual layers, these values constitute a good measure of the thermal stability of the emulsions in the finished, packed film material. The results are given in Tables 4, 5 and 6.

TABLE 4

| | rel. S | F | ΔS (pack) |
|---|---|---|---|
| Em-1 | 100 | 36 | −15 |
| Em-4 | 99 | 35 | −13 |
| Em-5 | 97 | 36 | −14 |
| Em-6 | 131 | 34 | −17 |
| Em-7 | 102 | 35 | −12 |
| Em-8 | 104 | 33 | −11 |
| Em-9 | 98 | 34 | −13 |
| Em-10 | 102 | 34 | −15 |
| Em-11 | 139 | 36 | −5 |
| Em-12 | 144 | 34 | −4 |
| Em-13 | 137 | 32 | −5 |
| Em-14 | 141 | 33 | −4 |
| Em-15 | 145 | 34 | −3 |
| Em-16 | 147 | 33 | −3 |
| Em-17 | 152 | 34 | −4 |
| Em-18 | 149 | 32 | −5 |
| Em-19 | 135 | 35 | −6 |
| Em-20 | 142 | 34 | −4 |
| Em-21 | 139 | 31 | −4 |
| Em-22 | 137 | 32 | −5 |

TABLE 5

| | rel. S | F | ΔS (pack) |
|---|---|---|---|
| Em-2 | 100 | 34 | −18 |
| Em-23 | 102 | 35 | −15 |
| Em-24 | 99 | 34 | −14 |
| Em-25 | 101 | 35 | −13 |
| Em-26 | 100 | 36 | −15 |
| Em-27 | 98 | 34 | −14 |
| Em-28 | 97 | 34 | −17 |
| Em-29 | 103 | 35 | −14 |
| Em-30 | 145 | 34 | −5 |
| Em-31 | 151 | 35 | −6 |
| Em-32 | 143 | 35 | −5 |
| Em-33 | 150 | 36 | −4 |
| Em-34 | 152 | 34 | −5 |
| Em-35 | 138 | 35 | −5 |
| Em-36 | 147 | 34 | −6 |
| Em-37 | 141 | 34 | −4 |
| Em-38 | 142 | 33 | −4 |
| Em-39 | 145 | 34 | −5 |
| Em-40 | 142 | 35 | −4 |
| Em-41 | 143 | 34 | −6 |

TABLE 6

| | rel. S | F | ΔS (pack) |
|---|---|---|---|
| Em-3 | 100 | 38 | −21 |
| Em-42 | 103 | 36 | −18 |
| Em-43 | 99 | 37 | −22 |
| Em-44 | 100 | 37 | −19 |
| Em-45 | 102 | 36 | −21 |
| Em-46 | 104 | 36 | −17 |
| Em-47 | 97 | 35 | −15 |
| Em-48 | 98 | 35 | −19 |
| Em-49 | 136 | 36 | −6 |
| Em-50 | 134 | 35 | −7 |
| Em-51 | 140 | 37 | −4 |
| Em-52 | 132 | 37 | −7 |
| Em-53 | 133 | 36 | −5 |
| Em-54 | 141 | 35 | −6 |
| Em-55 | 144 | 36 | −6 |
| Em-56 | 149 | 35 | −7 |
| Em-57 | 132 | 34 | −5 |
| Em-58 | 135 | 35 | −4 |
| Em-59 | 140 | 37 | −5 |
| Em-60 | 141 | 36 | −6 |

It can be seen that the photographic layers comprising the emulsions according to the invention exhibited a significantly higher speed with low fogging, as well as very good stability in their packed state.

EXAMPLE 2

A colour photographic recording material for colour negative colour development was produced (layer structure 2A) by depositing the following layers in the given sequence on a transparent film base made of cellulose acetate. The quantitative data are given with respect to 1 $m^2$ in each case. The corresponding amounts of $AgNO_3$ are quoted for silver halide deposition. The silver halides were stabilised with 4 mmol ST-1 and 80 $\mu$mol ST-2 per mol $AgNO_3$. All the emulsions were chemically ripened in the optimum manner with sulphur, selenium and gold.

1st Layer (anti-halo layer)

| | |
|---|---|
| 0.3 g | black colloidal silver |
| 1.2 g | gelatine |
| 0.3 g | UV absorber UV-1 |
| 0.2 g | DOP scavenger SC-1 |
| 0.02 g | tricresyl phosphate (TCP) |

2nd Layer (low red-sensitivity layer)

| | |
|---|---|
| 0.7 g | $AgNO_3$ of an AgBrI emulsion, spectrally sensitised to red, 4 mol % iodide, average grain diameter 0.42 μm, aspect ratio 5, breadth of distribution 25% |
| 1 g | gelatine |
| 0.35 g | colourless coupler C-1 |
| 0.05 g | coloured coupler RC-1 |
| 0.03 g | coloured coupler YC-1 |
| 0.36 g | TCP |

3rd Layer (Medium Red-sensitivity Layer)

| | |
|---|---|
| 0.8 g | $AgNO_3$ of an AgBrI emulsion, spectrally sensitised to red, 5 mol % iodide, average grain diameter 0.53 μm, aspect ratio 6, breadth of distribution 23% |
| 0.6 g | gelatine |
| 0.15 g | colourless coupler C-2 |
| 0.03 g | coloured coupler RC-1 |
| 0.02 g | DIR coupler D-1 |
| 0.18 g | TCP |

4th Layer (High Red-sensitivity Layer)

| | |
|---|---|
| 1 g | $AgNO_3$ of an AgBrI emulsion, spectrally sensitised to red, 6 mol % iodide, average grain diameter 0.85 μm, aspect ratio 9, breadth of distribution 20% |
| 1 g | gelatine |
| 0.1 g | colourless coupler C-2 |
| 0.005 g | DIR coupler D-2 |
| 0.11 g | TCP |

5th Layer (intermediate layer)

| | |
|---|---|
| 0.8 g | gelatine |
| 0.07 g | DOP scavenger SC-2 |
| 0.06 g | aluminium salt of aurin-tricarboxylic acid |

6th Layer (Low Green-sensitivity Layer)

| | |
|---|---|
| 0.7 g | $AgNO_3$ of an AgBrI emulsion, spectrally sensitised to green, 4 mol % iodide, average grain diameter 0.35 μm, aspect ratio 5, breadth of distribution 20% |
| 0.8 g | gelatine |
| 0.22 g | colourless coupler M-1 |
| 0.065 g | coloured coupler YM-1 |
| 0.02 g | DIR coupler D-3 |
| 0.2 g | TCP |

7th Layer (Medium Green-sensitivity Layer)

| | |
|---|---|
| 0.9 g | $AgNO_3$ of Em-1 |
| 1 g | gelatine |
| 0.16 g | colourless coupler M-1 |
| 0.04 g | coloured coupler YM-1 |
| 0.015 g | DIR coupler D-4 |
| 0.14 g | TCP |

8th Layer (High Green-sensitivity Layer)

| | |
|---|---|
| 0.6 g | $AgNO_3$ of Em-2 |
| 1.1 g | gelatine |
| 0.05 g | colourless coupler M-2 |
| 0.01 g | coloured coupler YM-2 |
| 0.02 g | DIR coupler D-5 |
| 0.08 g | TCP |

9th Layer (Yellow Filter Layer)

| | |
|---|---|
| 0.09 g | yellow dye GF-1 |
| 1 g | gelatine |
| 0.08 g | DOP scavenger SC-2 |
| 0.26 g | TCP |

10th Layer (Low Blue-sensitivity Layer)

| | |
|---|---|
| 0.3 g | $AgNO_3$ of an AgBrI emulsion, spectrally sensitised to blue, 6 mol % iodide, average grain diameter 0.44 μm, aspect ratio 4, breadth of distribution 20%, |
| 0.5 g | $AgNO_3$ of an AgBrI emulsion, spectrally sensitised to blue, 6 mol % iodide, average grain diameter 0.50 μm, aspect ratio 5, breadth of distribution 18%, |
| 1.9 g | gelatine |
| 1.1 g | colourless coupler Y-1 |
| 0.037 g | DIR coupler D-6 |
| 0.6 g | TCP |

11th Layer (High Blue-sensitivity Layer)

| | |
|---|---|
| 0.6 g | $AgNO_3$ of an AgBrI emulsion, spectrally sensitised to blue, 6 mol % iodide, average grain diameter 0.82 μm, aspect ratio 12, breadth of distribution 22%, |
| 1.2 g | gelatine |
| 0.1 g | colourless coupler Y-1 |
| 0.006 g | DIR coupler D-7 |
| 0.11 g | TCP |

12th Layer (Micrate Layer)

| | |
|---|---|
| 0.1 g | $AgNO_3$ of a micrate-AgBrI emulsion, 0.5 mol % iodide, average grain diameter 0.06 μm, |
| 1 g | gelatine |
| 0.004 mg | $K_2[PdCl_4]$ |
| 0.4 g | UV absorber UV-2 |
| 0.3 g | TCP |

13th Layer (Protective and Hardener Layer)
| | |
|---|---|
| 0.25 g | gelatine |
| 0.75 g | hardener H-1 |
After hardening, the overall layer structure had a swelling factor ≦3.5.
Substances used in Example 1:
UV-1
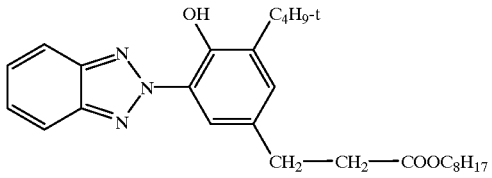
UV-2
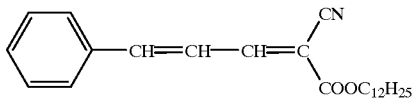
C-1
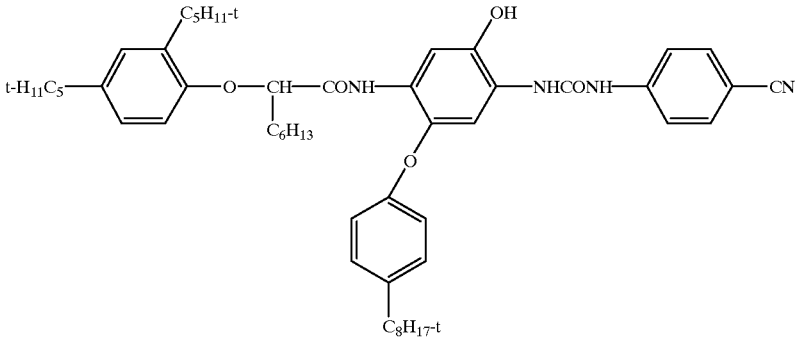
C-2
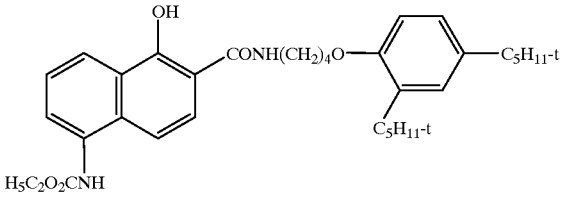
RC-1
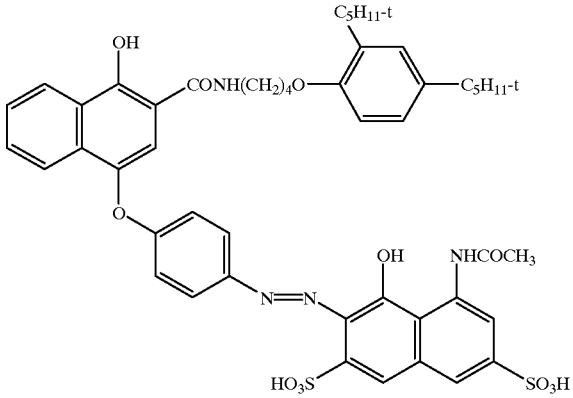

-continued
YC-1
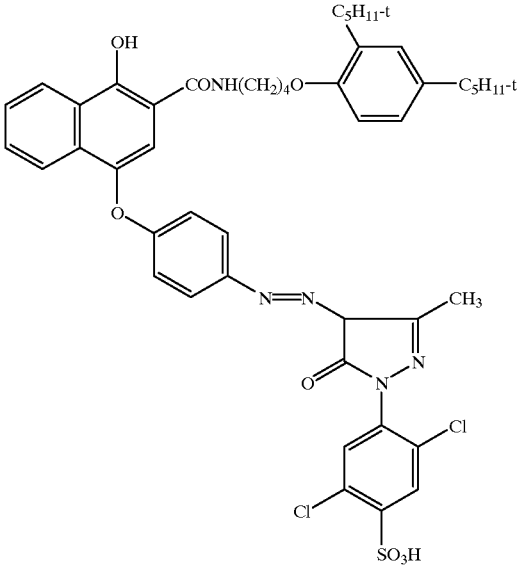
M-1
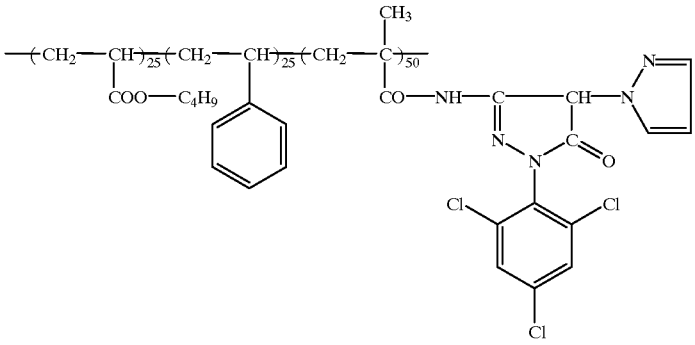
M-2
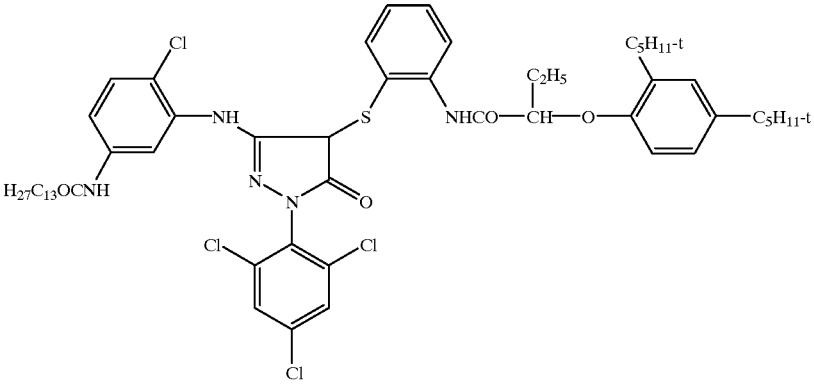

-continued
YM-1
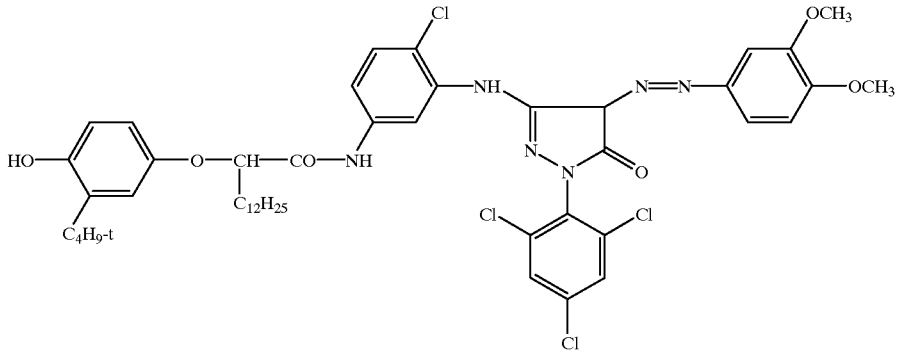
YM-2
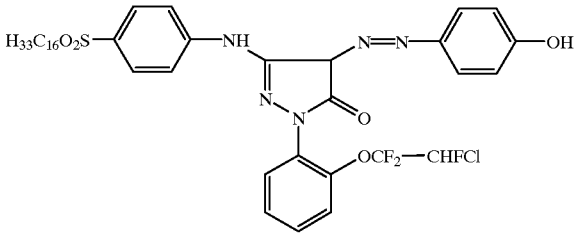
Y-1
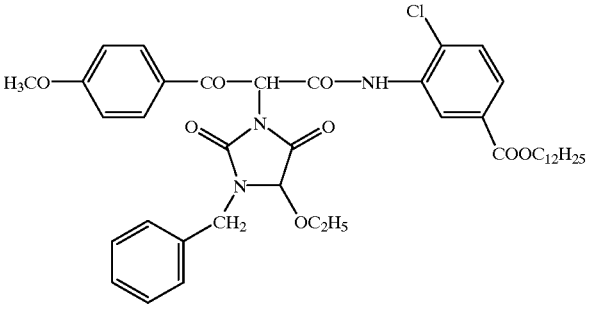
D-1
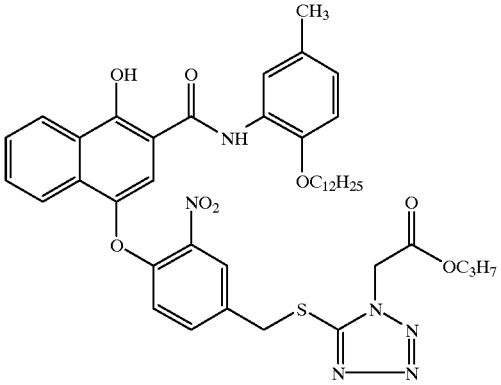
D-2
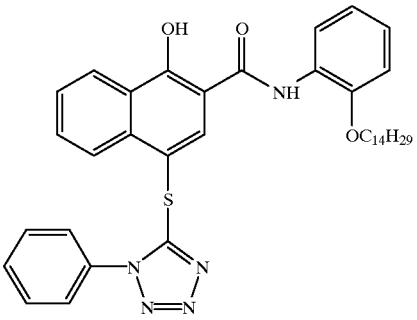
D-3
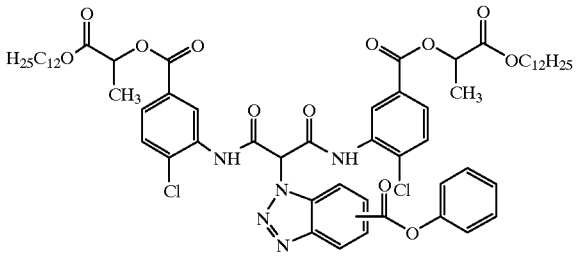
D-4
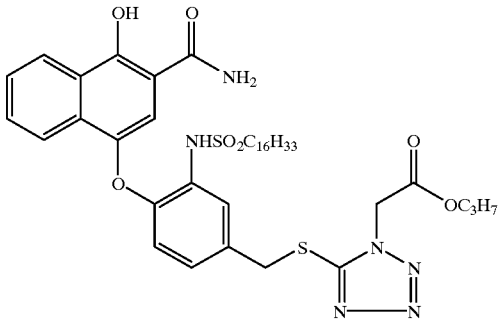

-continued

D-5

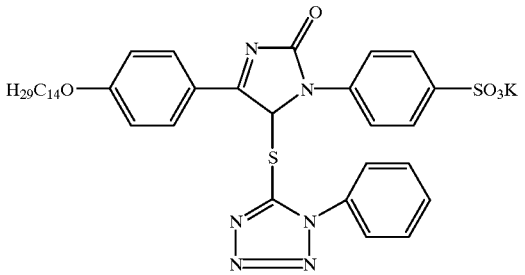

D-6

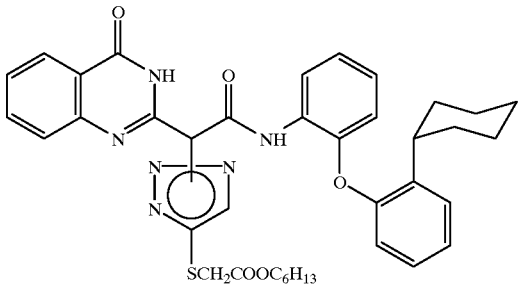

D-7

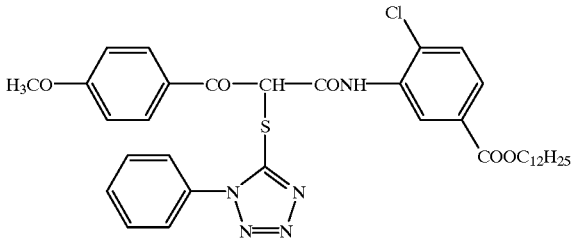

SC-1

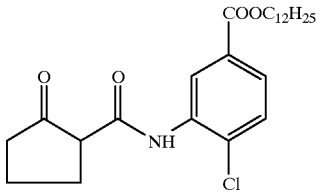

SC-2

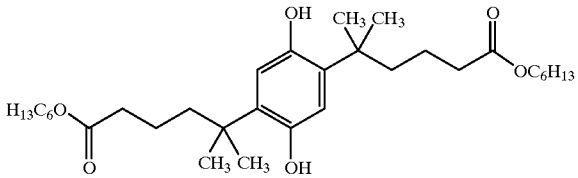

GF-1

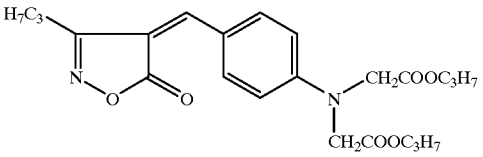

H-1

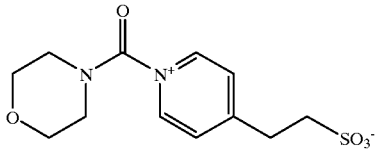

Layer structures 2B to 2N were produced as for 2A, except that emulsion Em-2 in the 8th layer was replaced by the emulsions listed in Table 7.

The dried film samples were exposed to daylight behind a graduated neutral wedge filter. Thereafter, the materials were processed by the process described in The British Journal of Photography 1974, page 597. The speed (S), fogging (F) and ΔS(pack) were determined (see Example 1). The speed data are given with respect to a density of 0.2 above fogging, with relative values being quoted, and with the speed of emulsion Em-1 being arbitrarily given the numerical value of 100.

The results are given in Table 7.

TABLE 7

| Layer structure | Emulsion in the 8th layer | S (magenta) | F (magenta) | ΔS (pack) (magenta) | |
|---|---|---|---|---|---|
| 2A | Em-2 | 100 | 60 | −15 | comparison |
| 2B | Em-23 | 101 | 61 | −14 | comparison |
| 2C | Em-24 | 100 | 59 | −13 | comparison |
| 2D | Em-25 | 102 | 60 | −14 | comparison |
| 2E | Em-30 | 121 | 61 | −3 | invention |
| 2F | Em-31 | 123 | 60 | −4 | invention |
| 2G | Em-32 | 120 | 59 | −3 | invention |

TABLE 7-continued

| Layer structure | Emulsion in the 8th layer | S (magenta) | F (magenta) | ΔS (pack) (magenta) | |
|---|---|---|---|---|---|
| 2H | Em-33 | 125 | 59 | −4 | invention |
| 2I | Em-34 | 125 | 60 | −5 | invention |
| 2J | Em-35 | 119 | 59 | −3 | invention |
| 2K | Em-36 | 123 | 60 | −5 | invention |
| 2L | Em-37 | 120 | 61 | −3 | invention |
| 2M | Em-38 | 119 | 59 | −5 | invention |
| 2N | Em-39 | 121 | 59 | −4 | invention |
| 2O | Em-40 | 120 | 61 | −5 | invention |
| 2P | Em-41 | 120 | 60 | −4 | invention |

It can be seen that the film samples comprising the emulsions according to the invention exhibited a significantly higher speed with low fogging, as well as very good thermal stability in their packed state.

What is claimed is:

1. A process for producing tabular silver bromide-iodide and silver bromide-chloride-iodide emulsions with an aspect ratio ≧2, an iodide content from 1 to 40 mol % and a chloride content from 0 to 20 mol %, which comprises the process steps of (a) silver halide nucleus precipitation, and (b) at least one further precipitation of silver halide, at least one aromatic five- or six-membered, heterocyclic compound, which is free from—SH—, —$SSO_2H$— and —$SSO_2R$ groups, is added in an amount from $10^{-9}$ to $10^{-4}$ mol silver during nucleus precipitation or during the precipitation of an inner zone of the silver halide grain which is different from the nucleus precipitate.

2. A process according to claim 1, which further comprises silver halide precipitations following nucleus precipitation are effected by adding soluble silver salts and soluble halides or by adding and depositing a fine-grained micrate emulsion.

3. A process according to claim 1, wherein the aspect ratio is 4 to 30 and the iodide content is 3 to 20 mol %.

4. A process according to claim 1, wherein the nucleus precipitate is an AgCl, AgBr, AgI, AgClBr, AgBrI, or AgCIBI emulsion.

5. A process according to claim 1, wherein the at least one heterocyclic compound is used in an amount from $10^{-8}$ to $10^{-5}$ mol/mol silver.

6. The process according to claim 1, wherein the at least one heterocyclic compound corresponds to one of formulae I to VII (I)

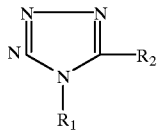

wherein $R_1$ denotes H, alkyl or aryl, $R_2$ denotes —$SR_3$ or —$NHCOR_3$, and $R_3$ denotes alkyl;

(II)

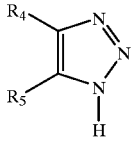

wherein $R_4$ denotes H, alkyl, aryl or —S—$R_3$ $R_5$ denotes H, alkyl, aryl, —$SR_3$, —$COR_6$, —$COOR_6$, CN or hetaryl, $R_6$ denotes alkyl or aryl, and $R_3$ is alkyl;

(III)

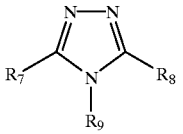

wherein $R_7$ and $R_8$, independently of each other, denote H, alkyl, —$SR_3$, aryl or hetaryl, $R_9$, denotes H or alkyl, and $R_3$ is alkyl;

(IV)

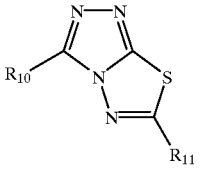

wherein $R_{10}$ and $R_{11}$, independently of each other, denote H, alkyl or —$SR_3$ and $R_3$ is alkyl;

(V)

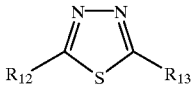

wherein the radicals $R_{12}$ and $R_{13}$ are identical or different and denote H, alkyl, —$NH_2$ or —$SR_3$ wherein $R_3$ is alkyl;

(VI)

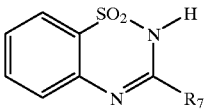

wherein $R_3$ and $R_7$ are defined above;

(VII)

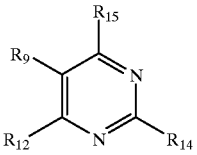

wherein $R_{14}$ denotes H, alkyl, —$SR_3$ or $NHCOR_3$;

$R_{15}$ denotes H, alkyl, $NH_2$ or OH, and $R_3$, $R_9$ and $R_{12}$ are defined above.

7. The process as claimed in claim 6, wherein the compound of the formula (I) is used.

8. The process according to claim 6, wherein the compound of the formula (II) is used.

9. A process according to claim 7, which further comprises a compound of the formula (II) is used.

10. A process according to claim 9, wherein $R_1$ is hydrogen and $R_2$ is —S—$CH_2$—COOH.

11. A process according to claim 7, wherein $R_1$ is hydrogen and $R_2$ is —S—$CH_2$—COOH or —$NHCOCH_3$.

12. A process according to claim 8, wherein $R_4$ is $CH_3$, H, 4-chlorophenyl or —$SC_5H_{11}$.

13. A process according to claim 9, wherein $R_4$ is $CH_3$, H, 4-chlorophenyl or —$SC_5H_{11}$.

* * * * *

UNITED STATES PATENT AND TRADEMARK OFFICE

CERTIFICATE OF CORRECTION

PATENT NO. : 6,261,758 B1
DATED : July 17, 200
INVENTOR(S) : Wirowski *et al.*

It is certified that error appears in the above-identified patent and that said Letters Patent is hereby corrected as shown below:

Column 22, claim 1,
Line 63, "ratio ≥2," should read as -- ratio ≥2 --.

Column 23, claim 1,
Line 3, "mol silver" should read as -- mol/mol silver --.

Column 23, claim 4,
Line 14, "AgBrl," should read as -- AgBrI, --.

Column 23, claim 4,
Line 15, "AgCIBI" should read as -- AgC1BrI --.

Column 23, claim 6,
Line 65, "$R_9$," should read as -- $R_9$ --.

Signed and Sealed this

Twenty-sixth Day of March, 2002

*Attest:*

*Attesting Officer*

JAMES E. ROGAN
*Director of the United States Patent and Trademark Office*